United States Patent [19]

Dunford et al.

[11] Patent Number: 4,606,928

[45] Date of Patent: Aug. 19, 1986

[54] VORTEX EFFECT ELECTROSTATIC FLUIDIZED BED COATING METHOD AND APPARATUS

[75] Inventors: William J. Dunford, Watertown; Bedrich Hajek, New Haven, both of Conn.

[73] Assignee: Electrostatic Technology Incorporated, New Haven, Conn.

[21] Appl. No.: 708,989

[22] Filed: Mar. 7, 1985

[51] Int. Cl.[4] ..... B05D 1/24

[52] U.S. Cl. ..... 427/32; 427/27; 427/185; 118/621; 118/627

[58] Field of Search ..... 118/621, 627; 427/27, 427/32, 185

[56] References Cited

U.S. PATENT DOCUMENTS

| | | |
|---|---|---|
| 2,421,787 | 6/1947 | Helmuth . |
| 2,777,784 | 1/1957 | Miller . |
| 3,108,022 | 10/1963 | Church . |
| 3,155,545 | 11/1964 | Rocks et al. . |
| 3,248,253 | 4/1966 | Barford et al. . |
| 3,326,182 | 6/1967 | Inoue . |
| 3,396,699 | 8/1968 | Beebe et al. . |
| 3,439,649 | 4/1969 | Probst et al. . |
| 3,476,081 | 11/1969 | Facer et al. . |
| 3,566,833 | 3/1971 | Beebe . |
| 3,607,998 | 9/1971 | Goodridge . |
| 3,828,729 | 8/1974 | Goodridge . |
| 3,834,927 | 9/1974 | Putney . |
| 3,916,826 | 11/1975 | Knudsen . |
| 4,011,832 | 3/1977 | Westervelt et al. . |
| 4,030,446 | 6/1977 | Karr . |
| 4,034,703 | 7/1977 | Scheiber et al. . |
| 4,051,809 | 10/1977 | Zickar et al. . |
| 4,084,019 | 4/1978 | Christ et al. . |
| 4,297,386 | 10/1981 | Gillette . |
| 4,329,377 | 5/1982 | Voelker et al. . |
| 4,330,567 | 5/1982 | Gillette . |
| 4,332,835 | 6/1982 | Knudsen . |
| 4,418,642 | 12/1983 | Gillette et al. . |
| 4,472,452 | 9/1984 | Gillette et al. . |

OTHER PUBLICATIONS

Webster's New Collegiate Dictionary, ©1975, G & C Merriam Co., p. 1313.

*Primary Examiner*—Richard Bueker

[57] ABSTRACT

An electrostatic fluidized bed coating method, apparatus and system utilize a vortex effect within the particle cloud to produce coatings of exceptional uniformity upon a workpiece. The vortex effect produces a secondary particle cloud and a secondary electrostatic field, which contribute to the uniformity of the deposit, and the amount of metal structure included in the unit may be minimized, also to enhance uniformity. Operation can be carried out at voltages that are significantly reduced from those required for similar systems known in the art.

24 Claims, 6 Drawing Figures

VORTEX EFFECT ELECTROSTATIC FLUIDIZED BED COATING METHOD AND APPARATUS

BACKGROUND OF THE INVENTION

A technique that is now widely used for insulating electrical conductors such as wires, and for producing coatings for other purposes and on other substrates, entails the exposure of a grounded workpiece to a cloud of electrostatically charged fusible particles, thereby causing the particles to deposit thereupon for subsequent integration. Typical of the apparatus used for that purpose are the devices disclosed and claimed in Knudsen and Karr U.S. Pat. Nos. 3,916,826 and 4,030,446, respectively; electrostatic fluidized bed equipment and systems that are highly effective for such coating are commercially available from Electrostatic Technology Incorporated, of New Haven, Conn.

A well-recognized problem associated with the electrostatic fluidized bed technique concerns the achievement of a uniform build upon the workpiece. The problem is most significant from the standpoint of achieving top-to-bottom uniformity, the lower surfaces tending to develop a heavier build than the upper surfaces, essentially because they are closest to the source of the particle cloud. This is believed to be attributable to two effects, one being the rarefaction or decrease in density of the cloud upwardly over the bed, and the other being a decreasing value of average electrostatic charge as the particles rise in the bed, due either to increasing remoteness from the voltage source or to dissipation of the original charge, or both.

The prior art has recognized these characteristics of electrostatic fluidized bed coating, and has proposed various solutions. Effective approaches are described in U.S. Pat. Nos. 4,297,386 and 4,330,567, to Gillette, No. 4,332,835 to Knudsen, and Nos. 4,418,642 and 4,472,452 to Gillette et al, wherein the nature of the particle cloud is controlled by electrical means. In U.S. Pat. No. 4,084,019, Christ et al employ electrode grids buried within the powder bed to form rows of localized corona discharges to either side of a passing substrate.

It is also common practice to mask the workpiece to control build, by interposing a physical barrier between it and the cloud. This as may be done by passing a wire to be coated through a tubular member, the extension of which into the coating chamber may be altered to vary the effective length of the workpiece exposed; such a method is described, for example, in Beebe et al U.S. Pat. Nos. 3,396,699, 3,566,833, and Voelker et al U.S. Pat. No. 4,329,377. Although the tubes utilized therein create a condition of either full exposure or full masking of the enclosed length of the workpiece, means for masking only a portion of the periphery is also known, as is disclosed in U.S. Pat. Nos. 3,828,729 to Goodridge, 4,011,832, to Westervelt, et al and 4,051,809 to Zicar et al, which also show baffles oriented to deflect the upwardly moving stream of particles over the top of the workpiece being coated. Hajek discloses an improved apparatus and method in U.S. application Ser. No. 6/543,858 (now U.S. Pat. No. 4,517,219) wherein a peripherally configured rectilinear bar is used for build control. In any event, the configuration of the build control means utilized, as well as the effective distance over which it influences the deposit on the workpiece, will have a very significant effect upon the nature of the coating produced.

The prior art discloses techniques, in addition to the foregoing, which also have the objective of producing uniform coatings upon articles of various kinds. For example, in U.S. Pat. No. 2,777,784, Miller teaches a method and apparatus in which an elongated article is surrounded by an atomizing edge, which may be in the form of a continuous helix encircling the travel path, to produce a coating by electrostatic attraction. In Barford et al U.S. Pat. No. 3,248,253, a workpiece, which may be wire, is conveyed through an annular arrangement of charging electrodes immersed within a powder bath (see FIGS. 5 and 6).

Guns and nozzles are of course also used for electrostatic coating, and it has been proposed to employ a number of them at spaced positions about the workpiece, as in U.S. Pat. Nos. 2,421,787 to Helmuth, 3,155,545 to Rocks et al, 3,439,649 to Probst et al, and 3,607,998 to Goodridge. Inoue describes an electrostatic spray device in U.S. Pat. No. 3,326,182, including a housing for directing a gas stream toward a surface to be sprayed; radially inclined apertures are used to introduce ionized particles into a discharge chamber of the housing, so that the axially propagated spray from a coaxial nozzle is displaced spiroidally in a vortex (column 3, lines 30–56).

Putney teaches a fluidized bed coating method, in U.S. Pat. No. 3,834,927, wherein the aerating gas is constrained to enter the bottom of the bed at a localized influx zone to promote uniformity in the bed, and hence in the deposit produced. Finally, in U.S. Pat. No. 4,034,703 Schieber et al disclose apparatus for coating elongated metal members utilizing a head immersed in the bed of powder, which has annular nozzles through which the particles are induced to flow onto the surface of the article.

Although at least certain of the foregoing methods and apparatus offer, to a greater or lesser extent, decided advantages over earlier practices, still the consistent attainment of coatings that conform to close thickness tolerances, and that are effectively isolated from external influences, remains a goal that has not been fully achieved. Thus, despite all of the activity evidenced by the foregoing a need remains for a method and apparatus for producing coatings of highly uniform thickness by electrostatic powder deposition, the quality of which is not unduly affected by changes in the position of the workpiece within the cloud of charged particles (particularly vertical spacing above a fluidized bed), from aberrant voltage and frequency variations experienced by the electrical system, and the like.

Accordingly, it is a primary object of the present invention to provide a novel method, apparatus, and system by which workpieces, and particularly conductors of continuous length, can be coated by electrostatic powder deposition, quickly, efficiently, safely, and with an exceptionally high degree of uniformity in the build.

It is also an object of the invention to provide such a novel method, apparatus and system, wherein the nature of the coating can readily be controlled by the speed of the workpiece and the magnitude of the voltage applied, is highly tolerant of changes of workpiece position within the cloud of charged particles, and is virtually unaffected by normal fugitive electrical effects, such as noise and static.

Another object of the invention is to provide such a method, apparatus and system wherein coating can be carried out in an electrostatic fluidized bed, at voltage levels that are significantly reduced from those heretofore employed for practical high-speed operation, thereby enhancing safety.

Still another object of the invention is to provide such a method, apparatus and system wherein economy of production is maximized by the significant reduction of waste produced during start-up and discontinuances of operation.

A still further object is to provide a novel coating unit which is uncomplicated and relatively inexpensive to manufacture and operate.

SUMMARY OF THE INVENTION

It has now been found that certain of the foregoing and related objects of the invention are attained by the provision of electrostatic fluidized bed coating apparatus, which includes a housing having opposed end wall portions and a generally planar and horizontally disposed porous support member defining a fluidization chamber thereabove and a plenum therebelow. The end wall portions of the housing have aligned openings therein spaced above the support member and defining a workpiece travel path therebetween. A vortex device is provided, which is adapted to receive a gas and to discharge it within the chamber in a generally helical flow path and substantially in the form of a vortex about and aligned substantially axially on at least a portion of the workpiece travel path. The apparatus also includes means for introducing gas into the plenum, for passage upwardly through the support member to effect fluidization of particulate coating material supplied to the chamber, and means to effect electrostatic charging of such particulate material. The cooperative effects of fluidization and electrostatic charging produce a cloud of electrostatically charged particulate material above the support member, and the vortex device produces a gaseous vortex about the travel path; the charged particles are entrained in the gaseous vortex for electrostatic attraction to and deposit upon a workpiece moving through it along the travel path.

Generally, the vortex device will be so disposed as to discharge gas supplied thereto about the opening of at least one of the end wall portions, and preferably the apparatus will include a second such device disposed to discharge gas about the opening of the other end wall portion as well. The two devices will cooperatively form a gaseous vortex along substantially the entire length of the workpiece travel path, and normally they will be adapted to discharge the gas so as to flow in the same direction of rotation and at substantially the same angular and lineal velocities.

In one particularly desirable form, the vortex device will comprise a body defining a generally toroidal internal chamber, and a generally circular discharge orifice communicating with the internal chamber and opening on one side of the body in a substantially axial direction. The device will have an inlet conduit communicating with, and having a flow axis disposed generally tangentially to, the internal chamber, so that gas introduced into the internal cavity through the inlet conduit will issue from the discharge orifice along a generally helical flow path. The internal chamber of the device will advantageously taper through a throat portion of narrow cross-section to a discharge orifice of continuous extent, the throat portion serving to promote gas flow in the axial direction.

Other objects of the invention are attained by the provision of a system for electrostatically coating a continuous length workpiece. The system comprises an electrostatic fluidized bed coating apparatus of the nature described above, together with means for continuously conveying the workpiece along the travel path through the apparatus housing. Preferably, the conveying means will be adapted to convey metal conductors, which may be of rectangular cross section.

Additional objects are attained in a method for producing a coating upon a workpiece, which includes the steps of producing a cloud of electrostatically charged particles in a coating chamber, causing a gas to flow along a generally helical path through the cloud to produce an elongated gaseous vortex of entrained charged particles therewithin, and conveying a workpiece, at an electrical potential effectively opposite to the charge on the particles, along a travel path through, and substantially coaxial with, the gaseous vortex. The particles entrained in the vortex will be attracted by and deposited upon the workpiece, so as to produce a coating of highly uniform thickness.

In the method, the gas of the vortex will typically have a lineal velocity of about 50 to 300 feet per minute and an angular velocity of about 500 to 3000 feet per minute, and the workpiece will normally be conveyed at a lineal speed of about 25 to 150 feet per minute. The vortex will preferably be produced by introducing the gas from two locations spaced along the travel path, and usually the flows of gas will be inwardly directed toward one another and in the same rotational direction, with the vortex tapering outwardly in both directions from an intermediate zone of relatively large dimensions traverse to the travel path.

Most desirably, the cloud of charged particles will be produced by generating a volume of highly ionized gas and passing it upwardly through a bed of the particles and into the coating chamber, to thereby simultaneously effect the fluidization and electrostatic charging thereof. The volume of ionized gas will advantageously be generated by passing a gas through an electrode charged to high voltage, typically having a value of about 40 to 50 kilovolts, and the workpiece will normally be at ground potential. The method is particularly well suited for the coating of conductors of continuous length, and is especially effective for producing insulation on rectangular wire, due to the high levels of surface and edge uniformity that are attainable.

Objects of the invention are also realized by the provision of a method in which a workpiece is conveyed along a travel path through a coating chamber, in spaced relationship to a high voltage source, and in which a primary cloud of electrostatically charged particles is produced by subjecting them to a primary electrostatic field having lines of force from the high voltage source toward the workpiece. The unique feature of the method involves causing a portion of the cloud to swirl about the periphery of the workpiece. This will produce a secondary cloud of generally tubular form about and generally coaxial with the travel path, and also a secondary electrostatic field having lines of force extending generally radially with respect to the workpiece and normal to the surface of the tubular cloud.

DETAILED DESCRIPTION OF THE ILLUSTRATED EMBODIMENT

Figure 1:
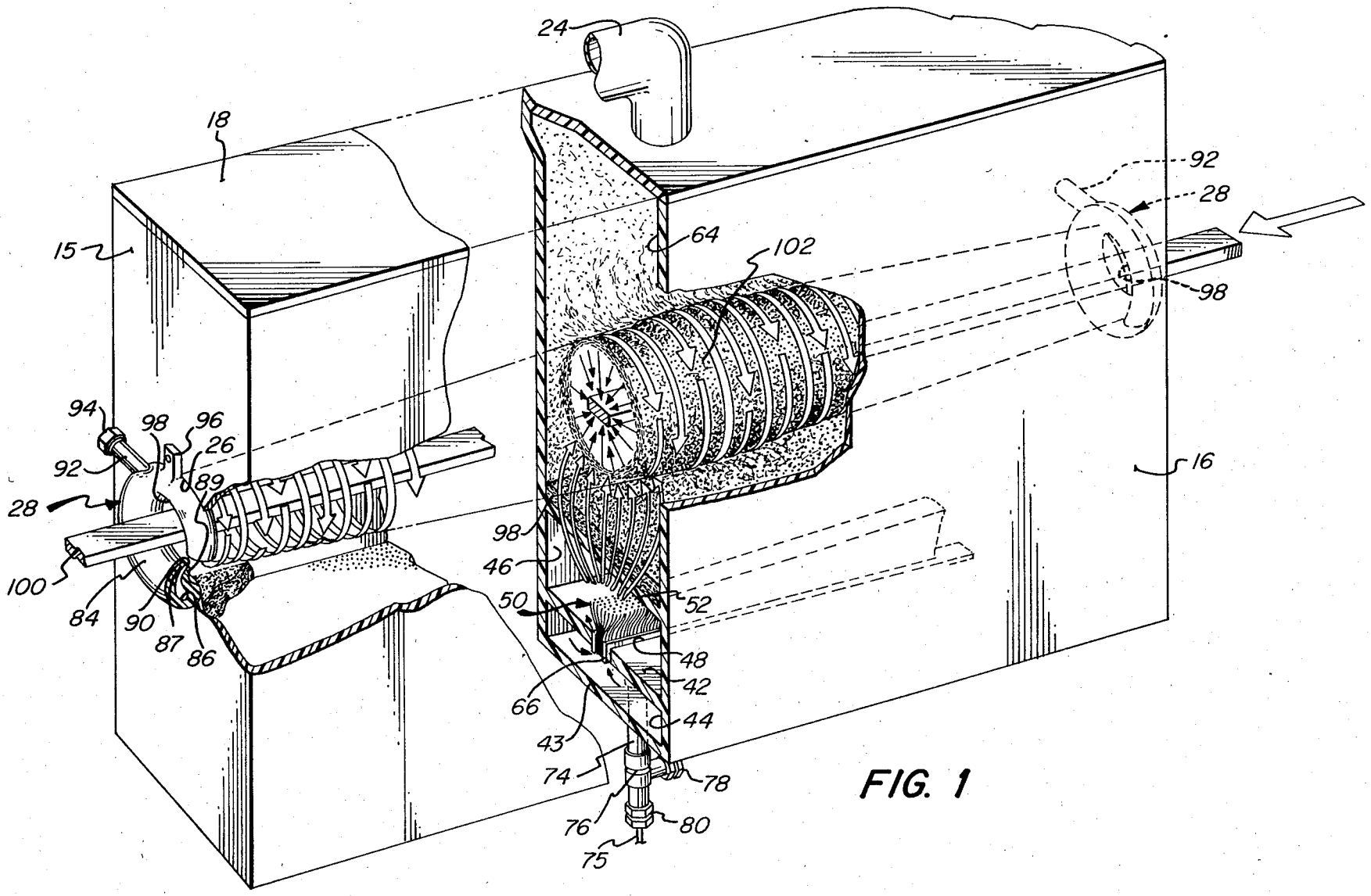
FIG. 1 is a fragmentary perspective view of an electrostatic fluidized bed coating unit embodying the present invention, with portions broken away to illustrate internal structure and phenomena taking place therewithin, and showing a rectangular conductor being coated during passage therethrough.
Figure 2:
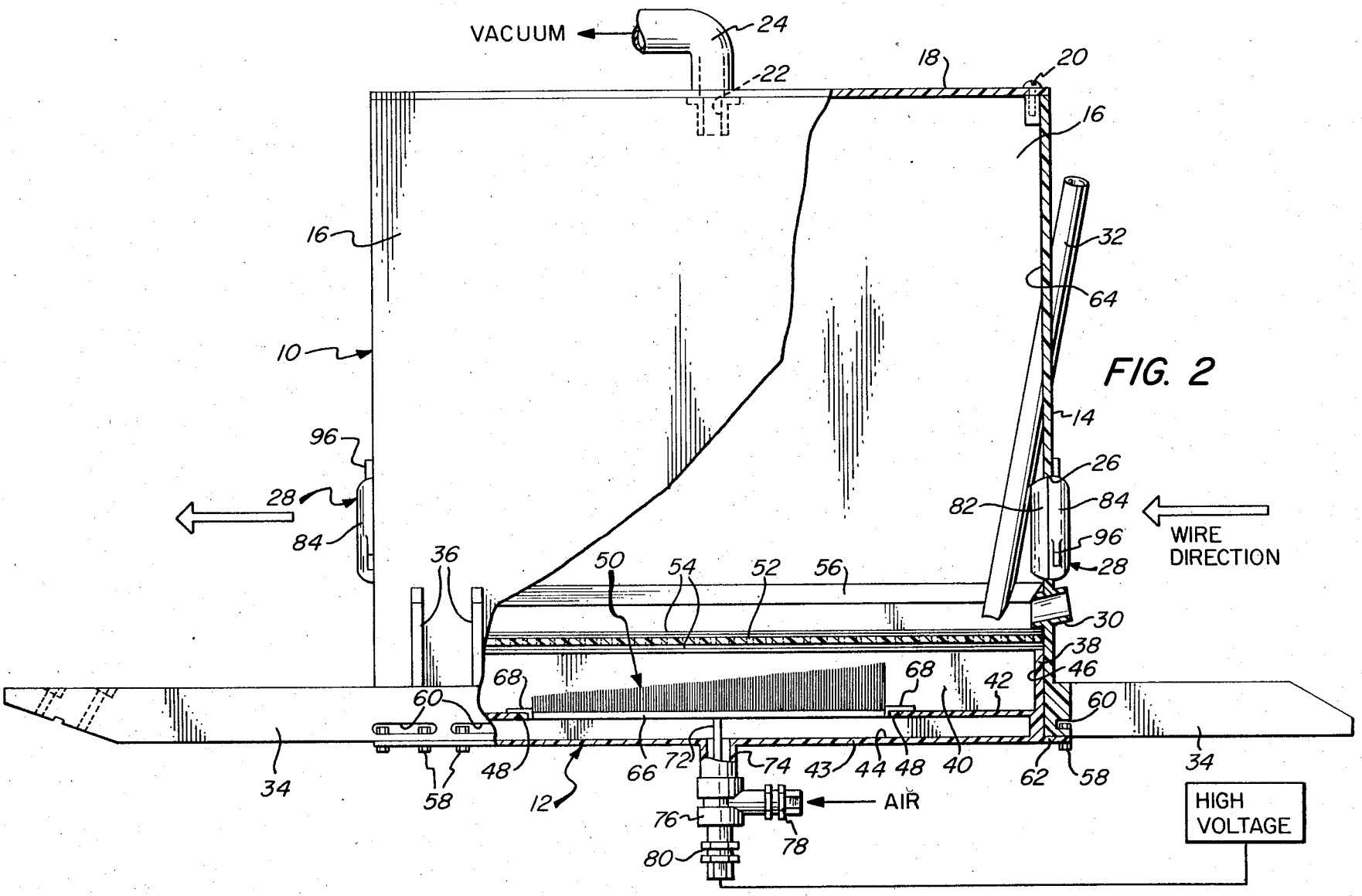
FIG. 2 is a side elevational view of the coating unit of FIG. 1, drawn to slightly different proportions and in partial section to illustrate details of construction.

Turning now in detail to the drawings, an electrostatic fluidized bed coating unit embodying the present invention is illustrated, and includes a rectangular housing; although for convenience the housing is shown as one piece in FIG. 1, a more practical construction is illustrated in FIG. 2, consisting of an external enclosure, generally designated by the numeral 10, and an internal base generally designated by the numeral 12. The enclosure 10 consists of upstream and downstream end walls 14 and 15, respectively, and sidewalls 16; a separate removable cover plate 18 is provided, normally being secured in place by a plurality of screws 20. An aperture 22 is formed through the cover plate 18, and a coupling piece 24 extends thereabout for connection into a vacuumized powder recovery system (not shown). The end walls 14, 15 have relatively large openings 26 therein, which are aligned with one another and will normally be disposed on a horizontal axis when the unit is in operative position. Mounted within each of the openings 26 is a vortex nozzle device, generally designated by the numeral 28; the nozzle devices will be described in fuller detail hereinbelow.

A short cylindrical sleeve element 30 extends through the end wall 14 at a level below the vortex device 28, and serves to mount a fluidic sensor (not shown), conventionally used in a unit of this type to determine and ensure (such as by feed-back control) the adequacy of the supply of coating powder. Also extending through the end wall 14 (at a position offset from the centerline of the unit) is a fill tube 32, which will normally be connected into a powder recovery system for delivery of the coating material to the bed. A pair of supporting beams 34 are attached along each side at the bottom of the enclosure 10, the assembly being strengthened by vertically extending buttresses 36, attached to the sidewalls 16 thereabove. The ends of the beams 34 are configured and prepared for convenient mounting of the unit within a suitable framework.

The base 12 of the housing also consists of integral end wall portions 38 and sidewall portions 40 (only one of each of which is visible in FIG. 2), which are dimensioned and configured to fit snugly within the opening formed at the lower end of the enclosure 10; as can be seen, the walls 38, 40 of the base 12 are relatively low, and extend only part way into the enclosure. An internal horizontal wall or plate 42 spans the bottom of the base section 12, and defines (with the bottom wall 43) a lower plenum 44 therebeneath and an upper plenum 46 thereabove. The plate 42 is made of non-conductive plastic, and has an elongated, rectilnear slot 48 extending along the major portion of its length, which is aligned on the longitudinal centerline of the unit. A wire brush electrode, generally designated by the numeral 50, is mounted within the slot 48; it too will be described more fully below.

Seated upon the upper edge of the peripheral wall formation (provided by the end walls 30 and sidewalls 40 of the base 12) is a porous support plate 52, which is dimensioned and configured to span the unit horizontally; the plate is of conventional construction for an electrostatic fluidized bed unit of this type, and defines the interface between the upper plenum 46 and the coating chamber 64 within the enclosure 10. Frame-like gasket pieces 54 extend about the periphery of the support plate 52 for sealing purposes, and the three parts are clamped in place between the upper edge of the base wall formation and the lower edge the shoulder formation 56, which projects inwardly from about the periphery of the enclosure. The two sections 10, 12 are secured together by a plurality of plastic (e.g., nylon) nut and bolt fasteners 58, which are accommodated by slots 60 formed at suitable locations along the sides and ends of the enclosure 10, and pass through holes formed therein and in the peripheral flange portion 62, which extends about the bottom of the base section 12. It will be understood that the sleeve 30 is disposed to position the fluidic sensor directly above the porous support plate 52, and that the inner end of the fill tube 32 is also disposed to deposit the powder directly upon its upper surface.

A unique feature of the unit resides in the construction and placement of the brush electrode 50. As mentioned above, it is disposed on the longitudinal centerline of the housing (directly under the workpiece travel path) and effectively provides the sole means for electrostatically charging the particles of the coating material. It will also be noted that the individual wires (unnumbered) of which the electrode 50 is constructed are progressively shorter in the downstream direction of coating (i.e., from end wall 14 to end wall 15), giving it a tapered configuration when viewed laterally, as in FIG. 2. With earlier, uniform-height electrode configurations, it was observed that the initial section of the bed did not produce a deposit upon a moving workpiece at rates comparable to those achieved at locations further downstream. It has been found that providing bristles of progressively increasing length toward the entrance end of the coater enables coating to commence earlier (thereby maximizing the effective length of the bed) and to proceed at optimal deposition rates, so as to produce highly desirable deposits, particularly on workpieces of continuous length. Moveover, it was also surprisingly found that placement of a single elongated electrode of this nature along the centerline of the unit is entirely adequate for efficient charging, and obviates any need for additional charging media laterally outwardly thereof, despite the fact that the coater may be relatively wide.

Figure 6:
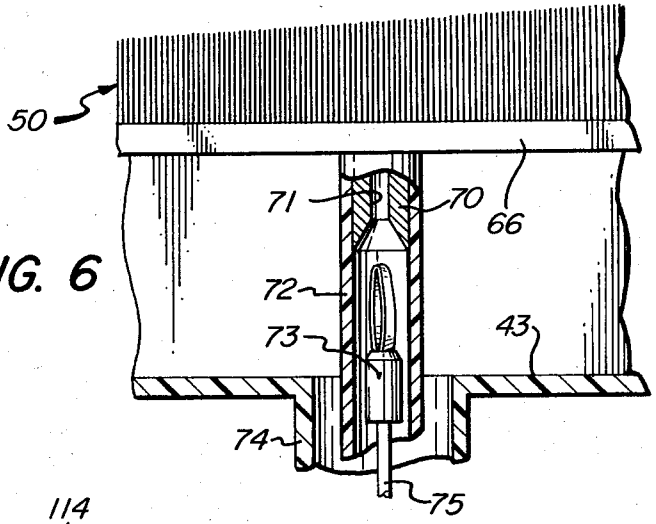
FIG. 6 is an enlarged sectional view of the structure provided at the bottom of the housing for connecting the gas and power supplies thereto.

The wire bristles of the electrode member 50 are supported upon an underlying metal channel piece 66 which, in turn, is mounted upon the plate 42 by angle brackets 68 at its opposite ends. A short cylindrical post 70 projects downwardly midway along the length of channel piece 66, and (as seen in FIG. 6) has a bore 71 formed therethrough with a conical entrace portion.

The bore is adapted to receive the male plug portion (or spade end) of a connecting jack 73 (e.g., a so-called "Jones plug"), enabling connection of the power cable 75 to the electrode 50 by a simple plug-in action. As can be seen, the cable 75 extends through a plastic insulating sleeve 72, which is secured upon the post 70 and extends downwardly through the tubular extension 74 on the bottom wall 43. A connecting tee 76 is mounted upon the end of the extension 74, and has male connectors 78, 80 thereon. The connector 78 serves to receive an air supply hose (not shown) and the connector 80 is adapted to engage a conduit for the power cable 75. This unique arrangement permits quick and facile installation and disconnection of the coating unit, and advantageously provides a single access location for both the power and also the fluidizing air supplies.

As will be appreciated, the unit operates by applying an appropriate voltage to the electrode 50 through the cable 75, while introducing air under pressure into the lower plenum 44 through the tube 74. The channel piece 66 is slightly narrower than the slot 48, permitting the air to flow through the gaps formed along the lateral edges thereof. As it does so, it comes into direct contact with the free outer end portions of the bristles of the electrode 50, causing the air to be ionized in a highly efficient manner due to the concentration of charges (normally producing a corona effect) thereat. The ionized air then passes through the upper plenum 46 and the porous plate 52, to simultaneously fluidize and electrostatically charge the powder of the bed 98 supported thereupon. The powder is attracted to and deposited upon the workpiece conveyed through the coating chamber 64 (normally at ground potential), in a manner that is now conventional and disclosed in certain of the prior art patents listed above, particularly Knudsen Pat. No. 3,916,826.

As discussed previously, a number of different principles and structures have been used, in connection with electrostatic fluidized powder coating units of the prior art, in efforts to achieve uniformity in the build upon the workpiece, and to make the coating operation less susceptible to external influences, such as fugitive electrical effects; in some instances, these efforts have met with notable success. The present invention, however, overcomes the disadvantageous inherent characteristics of electrostatic fluidized bed coating, and renders it more stable and tolerant to aberrant outside influences, in a manner that is facile and yet highly effective. These results are realized by the creation of a vortex in the cloud chamber, within which vortex coating of the workpiece is effected.

Figure 4:
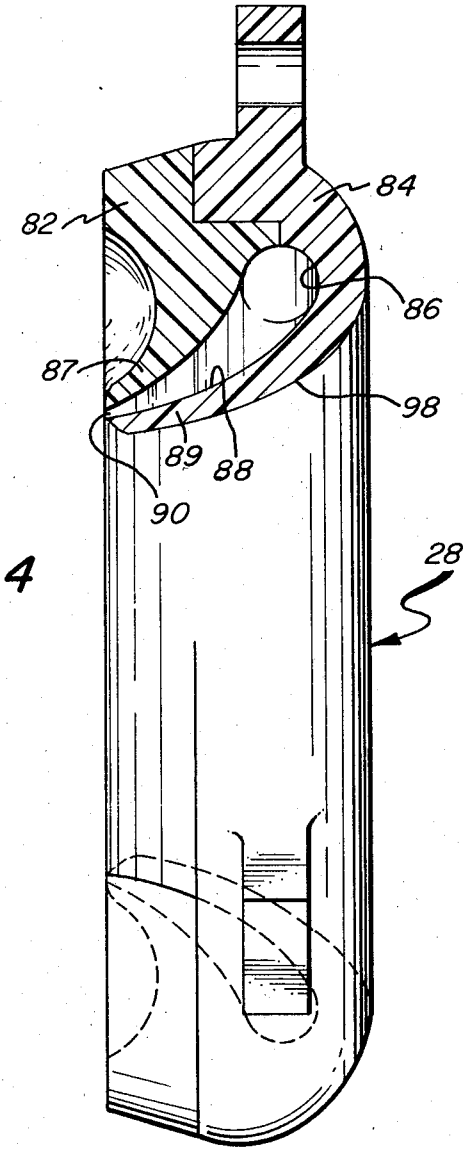
FIG. 4 is an elevational view of one of the vortex-creating nozzle devices employed in the coating unit, taken in partial section and drawn to a greatly enlarged scale.
Figure 3:
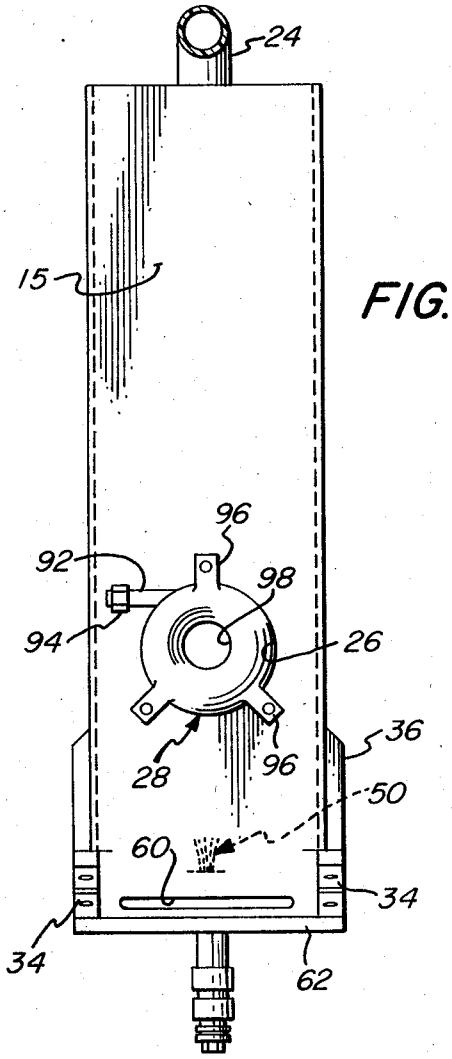
FIG. 3 is a downstream end view of the unit of the foregoing Figures, corresponding to the left side thereof and drawn to the scale of FIG. 2.

In the illustrated embodiment, a generally toroidal nozzle device 28 is employed at each end of the unit to discharge air inwardly of the coating chamber 64 along a helical path. It will be appreciated that the devices at the opposite ends differ only in the axial direction of air discharge, and are related to one another in mirror image fashion; accordingly only one need be described in detail. As best seen in FIG. 4, the nozzle device 28 consists of two shell sections 82, 84, cooperatively defining a toroidal internal passage 86 having a tapered, circumferential throat section 88 between the curved circular lips 87, 89, leading to a continuous circular discharge orifice 90; the aperture 98 through the center of the device 28 serves to permit passage of the workpiece. Extending into the passage 86 is an inlet tube 92, which intersects therewith in a generally tangential relationship; the outer end of the tube 92 is provided with a coupling piece 94 for attachment to a source of air under pressure. Three tabs 96 project radially from the outer periphery of the section 84, and provide the means by which the device is attached to the associated end wall 14, 15 of the closure 10, within the circular openings 26 thereof.

As indicated in FIG. 1, fluidization and electrostatic charging of the bed of powder 98 within the chamber 64 creates a cloud of particles under the influence of an electrostatic force field that extends generally vertically from the electrode 50 toward the workpiece 100, which is shown as a rectangular wire (the directional characterization of the force field will of course depend upon whether the electrode is charged negatively or positively, and is per se of no consequence to the invention). The air issuing from the two nozzle devices 28 proceeds inwardly from the opposite ends of the unit in the same direction of rotation (clockwise as viewed from the left side of FIG. 1) to provide a helical air flow path forming a vortex 102 about, and substantially coaxial with, the wire 100. As will be appreciated, the particles of coating material lifted from the bed 98 by the fluidizing air, and comprising the cloud thereabove, become entrained in the helical flow of air issuing from the vortex devices 28 and swirl about the workpiece 100, to which they will readily be attracted by electrostatic forces existing therebetween.

Thus, the suspension of the powder particles in the vortex provides a highly homogeneous secondary cloud surrounding the workpiece; the cloud has fairly well-defined boundaries which are visably discernable in the absence of the grounded workpiece. This homogeneity is believed to exit not only with respect to partical size distribution and density, but also as to the value of the charge on the individual particles. In progressing through the secondary cloud layer toward the grounded workpiece, the particles evidently acquire, through redistribution of electrons resulting from contact with and/or inductive influence upon one another, charges that are of virtually the same magnitude. It is believed that the extraordinarily uniform nature of the coating produced upon the workpiece is attributable primarily to these combined effects, which cause all surface of the workpiece to begin to coat at virtually the same time and the same rate.

In addition, the vortex appears to define therewithin a secondary electrostatic field, as can be confirmed by actual measurements, which indicate the existence of a magnetic field oriented longitudinally to its axis. The field within the vortex seems to be effectively isolated from the vertical field produced by the electrode 50, as well as from external electrical influences (e.g., noise, static, and the like), which if not so dampened tend to produce small but significant variations in the thickness of the build, such as along the length of a wire. The lines of force of the the secondary field are believed to be substantially radial with respect to the workpiece 100, and normal to the surface of vortex (as indicated by the arrows within the vortex in FIG. 1), and this effect is also believed to contribute very significantly to the high degree of uniformity in the deposit produced.

Perhaps it should be pointed out that the conditions of physical and charge homogeniety discussed above are expressed with reference to increments along the travel path; i.e., in planes perpendicular to it, producing high uniformity in a peripheral sense. Because, for example, the diameter of the vortex may increase toward the middle of the coating chamber, these parameters may not be the same from point-to-point along the length of the path; however, outstanding uniformity is achieved in that sense as well, evidently due largely to the dampening of electrical aberrations by the secondary electrostatic field.

It may be noted that the concept of utilizing air seals at the ends of fluidized bed coating chambers is not new, and has been disclosed in the art, exemplary of which are the U.S. patent to Church (No. 3,108,022) and Facer et al (No. 3,476,081). However, from the description provided it will readily be appreciated that the concept of the present invention is not merely that of providing air seals, although the vortex devices 28 do serve that additional function.

Figure 5:
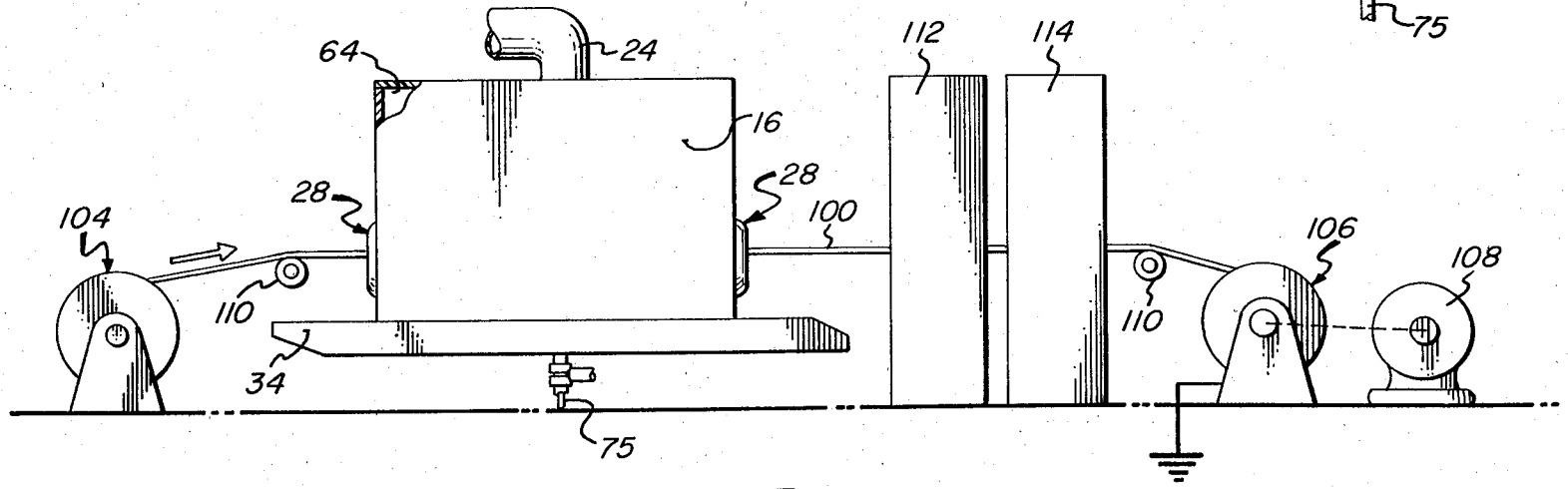
FIG. 5 is a diagrammatical elevational view of a wire coating system incorporating the unit of the foregoing Figures.

Turning now to FIG. 5 of the drawings, the coating unit shown in the system illustrated is that which was described in detail in connection with the foregoing Figures, and so need not be discussed further. The system also conveniently includes wire supply and take-up rolls, generally designated by the numerals 104 and 106, the strand of conductor 100 being played off from the supply roll 104 and wound upon the take-up roll 106 (shown here to be grounded, to effect grounding of the conductor), after passing through the fluidization chamber 64 of the coater. Drive means 108 for the take up roll 106, and appropriate support means for the conductor (such as the idler rolls 110), are illustrated, as are means 112 for heating the conductor and/or the deposit (to effect fusion of the latter) and means 114 for cooling (and thus hardening) the coating subsequent to fusion. As indicated above, powder recovery and recycle means will normally also be included in the system, and the conduit 116 is provided for conducting powder withdrawn to a collection unit.

Although the nozzle devices 28 shown for creating a helical gas flow will be preferred in most instances, it will be understood that different means may be employed for creating a circumferential and longitudinally progressing flow about the workpiece. For example, when a number of conductors are to be coated simultaneously and side-by-side within a single chamber, it may be desirable to induce flow in a generally elliptical path, in which instance nozzles or other injection devices appropriately configured or disposed for that purpose will be substituted. Moreover, although it is believed that the use of a vortex device at each of the opposite ends of the coating chamber will produce best results, this may not be necessary in all instances; e.g., when the path length is relatively short the provision of such a device at only one end may suffice. On the other hand, it may be desirable to include several such flow-inducing devices when the coating is relatively long, as by adding one within the chamber at a point along the travel path. The diameter (or transverse dimensions) of the vortex may vary considerably, and will depend largely upon the nature of the workpiece being coated. In a typical example, for a coating unit of the type illustrated, the diameter at the ends of the vortex may be about two and one-half inches, increasing to about five inches in the center.

Another unique feature of the invention resides in the fact that the position of the workpiece within the vortex may be varied considerably without material effect upon the nature of the coating produced. Whereas the travel path will be generally parallel to the axis of the vortex it can deviate considerably from a coaxial relationship, as long as the workpiece remains within the secondary cloud. In using prior art methods and apparatus for electrostatic coating, on the other hand, the location of the workpiece within the coating chamber will often have a crucial effect upon the build; this has traditionally imposed limitations for avoiding excessive lateral and (especially) vertical displacement of the substrate from the intended path.

As yet another benefit, it has been found that operation of the system can be commenced with very little if any of the trial and error that has heretofore been necessary to permit continuous production of product of commercial quality. This of course not only reduces man-hour expenditures, but also provides dramatic savings by avoiding much of the waste that is otherwise produced during such start-up operations.

It is important to note that, with the sole exception of the electrode member 50, the coating unit of the invention is virtually free of metal parts. This has not been the case in prior equipment in which plenum mounted electrodes have been used to produce ionized air, in which cases the mounting plate (such as 42 in the drawings) was itself conventionally made of metal. The elimination of metal structure within and on the unit has been found to contribute significantly to the ability to regulate the characteristics of the electrostatic fields produced within the unit, and hence the charge upon the particles. It is believed that these advantages are attributable to the elimination of capacitance, and of the consequential periodic accumulation and discharge of electrical energy during operation of the unit. In any event, the provision of a unit that is constructed virtually entirely of dielectric materials represents a further advance in the art, in addition to the other beneficial aspects of the invention discussed in detail hereinabove.

As to typical operating conditions, the fluidizing gas (normally air) will be introduced into the lower plenum at a rate sufficient to provide about seven to eight cubic feet per minute of air, per square foot of bed cross-sectional area (typically three to four square feet, in a unit such as that illustrated). The vortex-creating air will typically be injected at a rate of 75 to 100 cubic feet per hour, to discharge with an angular velocity of about 500 to 3000 feet per minute and a lineal velocity of about 50 to 300 feet per minute. The voltage applied to the electrode will usually be in the range of about 40 to 50 kilovolts, and it will be appreciated that this represents a significant decrease from prior practice, wherein potentials of 70 to 80 kilovolts were most common. As a result, the workpiece can be coated closer to the voltage source without arcing, and safety is enhanced. Wire conductors and other elongated workpieces can generally be coated at rates of about 25 to 150 feet per minute, and builds of the coating material ranging from 2 to 40 mils (i.e., 1 to 20 mils in thickness) can readily be achieved with high levels of uniformity. It should be appreciated that the indicated upper speed value of 150 feet per minute is attributable to the capacity of the heating units normally used to effect fusion of the particulate coating material, rather than to limitations of the coating equipment. That is to say, production speeds will undoubtedly increase as more efficient means for integrating the deposits becomes available.

Although it will generally be preferred to effect electrostatic charging of the particulate coating material by using an ionized fluidizing gas, other means may be substituted, such as may involve direct contact of the particles with an electrode burried in the bed. Also, while the invention has greatest applicability and benefit as applied to fluidized bed coating, the vortex of charged particles may be produced by other means, such as by using suitably designed nozzles disposed along the workpiece travel path to produce the necessary helical flow thereabout.

Finally, although the apparatus, system and method of the invention are particularly well suited for the coating of continuous length workpieces, such as round and rectangular wire, metal strip, screen, and the like, they may be employed to good advantage for coating individual articles (elongated or not) of a wide variety of types. Virtually any particulate or finely divided material that is capable of receiving and retaining an electrostatic charge may be used in the practice of the invention; however, the powder should, in addition, be capable of fluidizing well at an air flow rate of not less than about five cubic feet per minute, per square foot of bed (or porous support plate) area. Such materials are well known and constitute an extensive list, including both inorganic and organic resins, the latter typically being a polyolefin, an ethylenically unsaturated hydrocarbon polymer, an acrylic polymer, an epoxy resin, or the like; the coating material employed will normally have a particle size ranging from about 20 to 75 microns, with a bell-shaped curve distribution.

Thus, it can be seen that the present invention provides a novel method, apparatus, and system by which workpieces, and particularly conductors of continuous length, can be coated quickly, efficiently, safely, and with an exceptionally high degree of uniformity in the build. The nature of the coating produced can readily be controlled by the speed of the workpiece and the magnitude of the voltage applied, and the effects of workpiece position within the cloud of charged particles and of external electrical effects are minimized. Coating can be carried out at voltage levels that are significantly reduced from those heretofore employed for practical high-speed operation, thereby enhancing safety, and the economy of production is maximized by the significant reduction of waste produced during start-up and discontinuances of operation; the coating unit is uncomplicated and relatively inexpensive to manufacture and operate.

Having thus described the invention, what is claimed is:

1. Electrostatic fluidized bed coating apparatus comprised of: a housing including opposed end wall portions, and having a generally planar and horizontally disposed porous support member defining within said housing a fluidization chamber thereabove and a plenum therebelow, said end wall portions having aligned openings therein spaced above said support member and defining a workpiece travel path therebetween; a vortex device adapted to receive a gas and to discharge it within said chamber in a generally helical flow path about and aligned substantially axially on at least a portion of said travel path; means for introducing gas into said plenum for passage upwardly through said support member and independently of gas from said vortex device, to effect fluidization of particulate coating material supplied to said chamber; and means to effect electrostatic charging of such particulate material; whereby the cooperative effects of fluidization and electrostatic charging may produce a primary cluod of electrostatically charged particulate material above said support member, and whereby said vortex device may produce a secondary cloud of generally tubular form about said travel path in which the charged particulate material may be entrained for electrostatic attraction to and deposit upon a workpiece moving along said travel path therethrough.

2. The apparatus of claim 1 wherein said vortex device is so disposed as to discharge gas supplied thereto about said opening of at least one of said end wall portions.

3. The apparatus of claim 2 additionally including a second such vortex device, said second device being disposed so as to discharge gas supplied thereto about said opening of the other of said end wall portions of said housing, said vortex devices serving to cooperatively form said secondary cloud along substantially the entire length of said workpiece travel path.

4. The apparatus of claim 3 wherein said vortex devices are adapted to discharge gas to flow in the same direction of rotation, and at substantially the same angular and lineal velocities.

5. The apparatus of claim 4 wherein said vortex devices are mounted on said end wall portions with said discharge orifices thereof disposed within said chamber.

6. The apparatus of claim 1 wherein said vortex device comprises a body defining a generally toroidal internal chamber, a generally circular discharge orifice communicating with said internal chamber and opening on one side of said body in a substantially axial direction, and an inlet conduit communicating with, and having a flow axis disposed generally tangentially to, said internal chamber, whereby a gas introduced into said internal cavity through said inlet conduit will issue from said discharge orifice to flow along a generally helical path.

7. The apparatus of claim 6 wherein said internal chamber of said vortex device tapers through a circumferential throat portion of narrow cross section to said discharge orifice, said throat portion promoting gas flow in said axial direction and said orifice being of continuous extent.

8. The apparatus of claim 1 wherein said electrostatic charging means comprises means for ionizing the gas introduced into said plenum.

9. Electrostatic powder coating apparatus comprised of: a housing defining a coating chamber and including opposed end wall portions with aligned openings therein defining a workpiece travel path therebetween through said chamber; means for forming a primary cloud of electrostatically charged particles below said workpiece travel path; and means for forming a secondary, generally tubular-form cloud of electrostatically charged particles moving along a generally helical flow path about and aligned substantially axially on at least a portion of said travel path; whereby the charged particles of said secondary cloud may be electrostatically attracted to and deposited upon a workpiece moving along said travel path within said chamber.

10. A system for electostatically coating a continuous length workpiece comprising:

(a) electrostatic fluidized bed coating apparatus comprised of: a housing inlcuding opposed end wall portions, and having a generally planar and horizontally disposed porous support member defining within said housing a fluidization chamber thereabove and a plenum therebelow, said end wall portions having aligned openings therein spaced above said support member and defining a workpiece travel path therebetween; a vortex device adapted to receive a gas and to discharge it within said chamber in a generally helical flow path about and aligned substantially axially on at least a portion of said travel path; means for introducing gas into said plenum for passage upwardly through said support member and independently of gas from said vortex device, to effect fluidization of particulate coating material supplied to said chamber; and means to effect electrostatic charging of such particulate material; whereby the cooperative effects of fluidization and electrostatic charging may produce a primary cloud of electrostatically charged particulate material above said support member, and whereby said vortex device may produce a secondary cloud of generally tubular form about said travel path in which the charged particulate material may be entrained for electrostatic attraction to and deposit upon a workpiece moving along said travel path therethrough; and (b) means for continuously conveying such a workpiece along said travel path through said housing.

11. The system of claim 10 wherein said conveying means is adapted to convey metal conductors.

12. In a method for producing a coating upon a workpiece, the steps comprising:

(a) producing a primary cloud of electrostatically charged particles in a coating chamber;

(b) causing a gas to flow along a generally helical path through said primary cloud to produce a secondary, generally tubular cloud of entrained charged particles therewithin; and (c) conveying a workpiece, at an electrical potential effectively opposite to the charge on said particles, along a travel path through and aligned substantially axially with said secondary cloud, whereby said entrained particles will be attracted by an deposited upon said workpiece.

13. The method of claim 12 wherein said gas flowing along said generally helical path has a lineal velocity of about 50 to 300 feet per minute and an angular velocity of about 500 to 3000 feet per minute, and wherein said workpiece is conveyed at a lineal seed of about 25 to 150 feet per minute.

14. The method of claim 12 wherein said secondary cloud is produced by introducing said gas from two locations spaced along said travel path.

15. The method of claim 14 wherein the flows of gas from said locations are inwardly directed toward one another and in the same rotational direction, and wherein said second cloud tapers outwardly in both directions from an intermediate zone of relatively large dimensions traverse to said travel path.

16. The method of claim 12 wherein said workpiece is a metal conductor.

17. The method of claim 16 wherein said conductor is of rectangular cross section.

18. The method of claim 12 wherein said primary cloud of charged particles is produced by generating a volume of ionized gas and passing said ionized gas upwardly through a bed of the particles and into said chamber, to simultaneously effect the fluidization and electrostatic charging thereof.

19. The method of claim 18 wherein said volume of ionized gas is generated by passing a gas through an electrode charged to high voltage.

20. The method of claim 19 wherein said high voltage to which said electrode is charged has a value of about 40 to 50 kilovolts, and wherein said workpiece is maintained at ground potential.

21. The method of claim 18 wherein said volume of ionized gas is passed through said bed of particles at a rate of about seven to eight cubic feet per minute per square foot of horizontal cross-sectional area of said bed.

22. In a method for producing a coating upon a workpiece, the steps comprising:

(a) conveying a workpiece along a travel path through a coating chamber in spaced relationship to a high voltage source;

(b) producing a primary cloud of electrostatically charged particles by subjecting said particles to a primary electrostatic field having lines of force from said high voltage source toward said workpiece; and (c) causing a portion of said cloud to swirl about the periphery of said workpiece so as to produce a secondary cloud of generally tubular form about and on an axis generally aligned with that of said travel path, and to produce a secondary electrostatic field having lines of force extending generally radially with respect to said workpiece and normal to the surface of said tubular cloud.

23. The method of claim 22 wherein said workpiece is a conductor of continuous length, and wherein said conductor is continuously conveyed through said coating chamber, said secondary cloud being substantially coaxial with said conductor.

24. The method of claim 23 wherein said workpiece is grounded, and wherein said voltage source is at an electrical potential of about 40 to 50 kilovolts relative thereto.

* * * * *

UNITED STATES PATENT AND TRADEMARK OFFICE

CERTIFICATE OF CORRECTION

PATENT NO. : 4,606,928

DATED : August 19, 1986

INVENTOR(S) : William J. Dunford and Bedrich Hajek

It is certified that error appears in the above-identified patent and that said Letters Patent is hereby corrected as shown below:

Column 11, line 63, change "cluod" to --cloud--.

Column 13, line 48, change "second" to --secondary--.

Signed and Sealed this

Twenty-fourth Day of February, 1987

*Attest:*

DONALD J. QUIGG

*Attesting Officer* *Commissioner of Patents and Trademarks*